US005197616A

United States Patent [19]

Buono

[11] Patent Number: 5,197,616

[45] Date of Patent: Mar. 30, 1993

[54] CHILD-RESISTANT CLOSURE WITH AUDIBLE CLICK CLOSE INDICATOR

[75] Inventor: Caetano Buono, Staten Island, N.Y.

[73] Assignee: Van Blarcom Closures, Inc., Brooklyn, N.Y.

[21] Appl. No.: 902,949

[22] Filed: Jun. 23, 1992

[51] Int. Cl.[5] ..... B65D 55/02

[52] U.S. Cl. ..... 215/220; 215/206; 215/230

[58] Field of Search ..... 215/206, 216, 218, 219, 215/220, 223, 330, 331, 230; 220/DIG. 33

[56] References Cited

U.S. PATENT DOCUMENTS

| | | | |
|---|---|---|---|
| 3,690,495 | 9/1972 | Turner | 215/220 |
| 3,968,894 | 7/1976 | Herrmann | 215/220 |
| 4,107,961 | 8/1978 | Evans | 220/210 |
| 4,271,971 | 6/1981 | Morris . | |
| 4,394,916 | 7/1983 | Smalley | 215/220 |
| 4,410,098 | 10/1983 | Dubs et al. | 215/220 |
| 4,500,005 | 2/1985 | Forrester . | |
| 4,782,965 | 11/1988 | Wassilieff | 215/220 |
| 5,005,718 | 4/1991 | Buono | 215/220 |
| 5,110,003 | 5/1992 | MacWilliams | 220/304 |
| 5,115,929 | 5/1992 | Buono . | |

*Primary Examiner*—Gary E. Elkins
*Assistant Examiner*—Stephen Cronin
*Attorney, Agent, or Firm*—Cohen, Pontani, Lieberman, Pavane

[57] ABSTRACT

A child-resistant screw-on closure is provided with the closure having an audible close indicator signal and formed as a three-element closure. The outer cap is arranged for rotation relative to the centrally located middle cap and cooperates in a torquing manner with the middle cap so that, as the closure is rotated to close the container, the frictional engagement means engages the camming surface of the middle cap and until the frictional engagement means is rotated past the front end of the cam surface over the abutment point and onto the trailing end to produce the audible closure-state indicating "click" signal. Thus, the closure provides the user with a readily apparent audible indication as to whether the container closure is in its fully closed or container-sealing condition.

15 Claims, 2 Drawing Sheets

CHILD-RESISTANT CLOSURE WITH AUDIBLE CLICK CLOSE INDICATOR

FIELD OF INVENTION

This invention relates generally to a child-resistant screw-on closure for use on a container with the child-resistant screw-on closure including relatively rotatable components for audibly determining whether the closure is in a fully closed or sealed condition.

BACKGROUND OF THE INVENTION

The present invention relates generally to a child-resistant resistant closure device for determining whether the closure is in a fully closed or sealed condition. This allows the user to audibly determine whether the cap is in a safe "child-proof" condition an unsafe condition in which it may be removed from the threaded container by simple rotation.

More specifically, the subject invention is formed as a three-element child-resistant container closure, with the three elements coaxial and nested one within the other. The outermost element has a circular top with a cylindrical skirt and is arranged for rotation relative to the centrally-located or middle element which is similarly configured but nest within the outermost element. The outermost element is provided with an engagement means such as a radially extending engaging element on its inner skirt surface. The nested outermost and middle elements cooperate in a torquing manner so that, as the closure is rotated to close the container, as it approaches full closure, the radially extending engaging element rides over a camming surface on the outer surface of the skirt of the middle element until it abruptly disengages to produce an audible "click" sound, indicating full sealing, which is heard only when such sealing is complete. During rotative unsealing or opening of the container, the outermost element first moves relative to the remainder of the closure so that the engagement means abuts an abutment edge on the outer surface of the skirt of the middle element. Thus, the closure provides the user with an audible indication as to whether the container closure is in its fully closed or container-sealing condition.

Child-resistant closure devices for containers having a threaded neck are known and are described. However, prior art attempts have suffered from various drawbacks as discussed below.

For example, U.S. Pat. No. 4,271,971 to Morris discloses a three component safety cap for use on threaded containers which is rotationally operated so that the cap is either in a safe or "child proof" mode or an unsafe mode in that it may be removed from the threaded container by simple rotation. Optionally, the safety cap may include a visual indicator of its safe or unsafe condition. However, there is no indication in the reference of an outer cap having means for frictional engagement in order to provide an increasing interference fit between the middle and outer caps when the outer cap is rotated in a closed direction so that an audible "click" sound, indicating full sealing, is heard as taught herein.

U.S. Pat. No. 4,500,005 to Forrester discloses a tamper-evident cap assembly for a container having an externally screw-threaded top which ratchets from position to position. The outer cap has a window with the inner cap having an insignia which is not visible in the window when the outer cap is in its initial relatively clockwise position relative to the inner cap. This visual indicator operates as to whether the package has ever been opened. This reference, however, does not teach a child-resistant cap nor a three element cap in which the outer cap has means for frictional engagement with a radially differing groove portion of a middle cap which provides for an increase interference fit between the middle and outer caps so that an audible "click" sound, indicating full sealing, is heard.

Additionally, U.S. Pat. No. 5,115,929 to Buono, discloses a child-resistant closure having indicating means formed of an inner cap, a middle cap and an outer cap and a means for frictional engagement with a radially differing groove portion of the middle cap in order to provide an increasing interference fit between the middle and the outer caps as the outer cap is rotated in one direction. However, this reference does not teach the use of a frictional engagement means which is rotated past the front end of the cam surface, over the abutment edge and onto the trailing end of the cam surface in order to produce an audible closure-state indicating "click" signal.

None of the prior art, however, teaches or suggests a child-resistant closure for audibly determining whether the closure is in a fully closed or sealed condition formed of an inner cap, middle cap and an outer cap and a means for frictional engagement with a radially differing group portion of the middle cap in order to produce an audible closure-state indicating signal.

It is, therefore, an object of the invention to provide a child-resistant closure having relatively rotatable parts for audibly indicating whether the closure is in its fully sealed condition.

Another object of the invention is to provide a simple child-resistant closure with means for audibly indicating whether the cap is in a fully closed condition.

An additional object of the invention is to provide a simple child-resistant closure with a means for frictional engagement so as to prevent over torquing of the closure on the neck of the bottle.

A further object of the invention is to provide a child-resistant closure with audible "click" close indicating means which can be readily installed on a bottle during a manufacturing process.

Still other objects and advantages of the invention will in part be obvious and will in part be apparent from the specification.

SUMMARY OF THE INVENTION

Generally speaking, in accordance with the invention a child-resistant closure includes means for indicating by an audible signal such as a click, the closure-state of the container. The child-resistant closure includes coaxial nesting inner, middle and outer caps. The inner cap has a circular top wall portion and a cylindrical skirt depending from the top wall portion. The inner surface of the inner skirt is threaded for threaded engagement with a thread on the neck of a container when the inner cap is rotated in a closing direction and for disengagement therefrom when the inner cap is rotated in an opening direction. The inner cap also has a plurality of angularly extending knurlings located on the outer surface of the skirt, preferably adjacent the top wall portion.

A middle cap is provided which has a circular top wall portion and a cylindrical skirt coaxial with and peripherally surrounding the cylindrical skirt portion of the inner cap. The middle cap is axially displaceable relative to the inner cap. The inner portion of the skirt of the middle cap, preferably adjacent the top wall portion thereof, has a plurality of angularly extending knurlings complementary to and angled the same way as the plurality of angularly extending knurlings located on the outer skirt surface of the inner cap. These knurlings are provided so that when the middle cap is rotated in the opening direction, the complementary middle cap knurlings ride up the inner cap knurlings to prevent transmission of the rotational force from the middle cap to the inner cap unless an axial force is applied to the middle cap to prevent such camming action in which case the inner and middle caps rotate together.

The skirt of the middle cap also has a grooved slot around its circumference with a plurality of cammed surface, each having a front end and a trailing end along the circumference of the outer surface of the skirt. The radial distance from the front end of the cammed surface to the center of the middle cap is greater in the closing direction than the radial distance from the trailing end of the cammed surface to the center of the middle cap in the opening direction. The middle cap is also provided with an abutment edge located where the trailing end meets the front end of the cammed surface.

The child-resistant closure has an outer cap arranged for rotation relative to the middle and inner caps. The outer cap has a circular top, a cylindrical skirt coaxial with and peripherally surrounding the skirt of the middle cap and means for frictionally engaging the radially differing cammed surface on the skirt of the middle cap. Thus, the means for frictional engagement provides an increasing interference fit between the middle and outer caps as the outer cap is rotated in one direction so that the outer cap first frictionally engages the middle cap to the middle cap to remain stationary relative to (i.e. to rotate with) the outer cap. The complimentary knurlings on the middle and inner caps cam the middle and inner caps into engagement to cause the inner cap to remain stationary relative to the outer cap (i.e. to rotate with the outer cap) during closing. Thus, as force is applied to rotate the outer cap to fully close the container, the threaded portion of the inner cap seals the threaded portion of the container. Upon full closure being achieved, the inner and middle caps are prevented from rotating and continued torquing of the outer cap causes it to turn relative to the middle and inner caps, thus causing the means for frictional engagement on the outer cap to ride over the radially differing cammed surface of the middle cap until it is rotated past the front end of the cam surface, over the abutment edge and onto the trailing end of the cam surface, where its quick disengagement of the frictional engaging means and the cam causes an audible closure-state indicating click signal to be produced. Thus, a user can determine whether the closure is in a fully closed or sealed condition.

Conversely, when the outer cap is rotated in the opposite or opening direction with the application of both rotational and axial forces the outer cap first moves relative to the middle cap allowing the means for frictional engagement to contact the abutment edge so that the closure may be disengaged from the container.

The invention accordingly describes the features of construction, combination of elements, and arrangements of parts which will be exemplified in the constructions hereinafter set forth and the scope of the invention will be indicated in the claims.

DETAILED DESCRIPTION OF THE DRAWINGS

For a fuller understanding of the invention, reference is had to the following description taken in connection with the accompanying drawings in which.

For convenience of reference, like components, structural elements and features in the various figures are designated by the same reference numerals or characters.

DESCRIPTION OF THE PREFERRED EMBODIMENTS

The child-resistant closure provided in accordance with the invention, includes inner, middle and outer caps with the outer cap arranged for rotation relative to the middle and inner caps. The outer cap has a circular top, a cylindrical skirt coaxial with and peripherally surrounding the skirt of the middle cap and means for frictional engagement with the middle cap. Specifically, the means for frictional engagement with the radially differing cammed surface of the middle cap provides an increasing interference fit between the middle and outer caps as the outer cap is rotated in a closing direction so that the outer cap first frictionally engages the middle cap in a torquing manner causing the middle cap to remain stationary relative to the outer cap.

Figure 1:
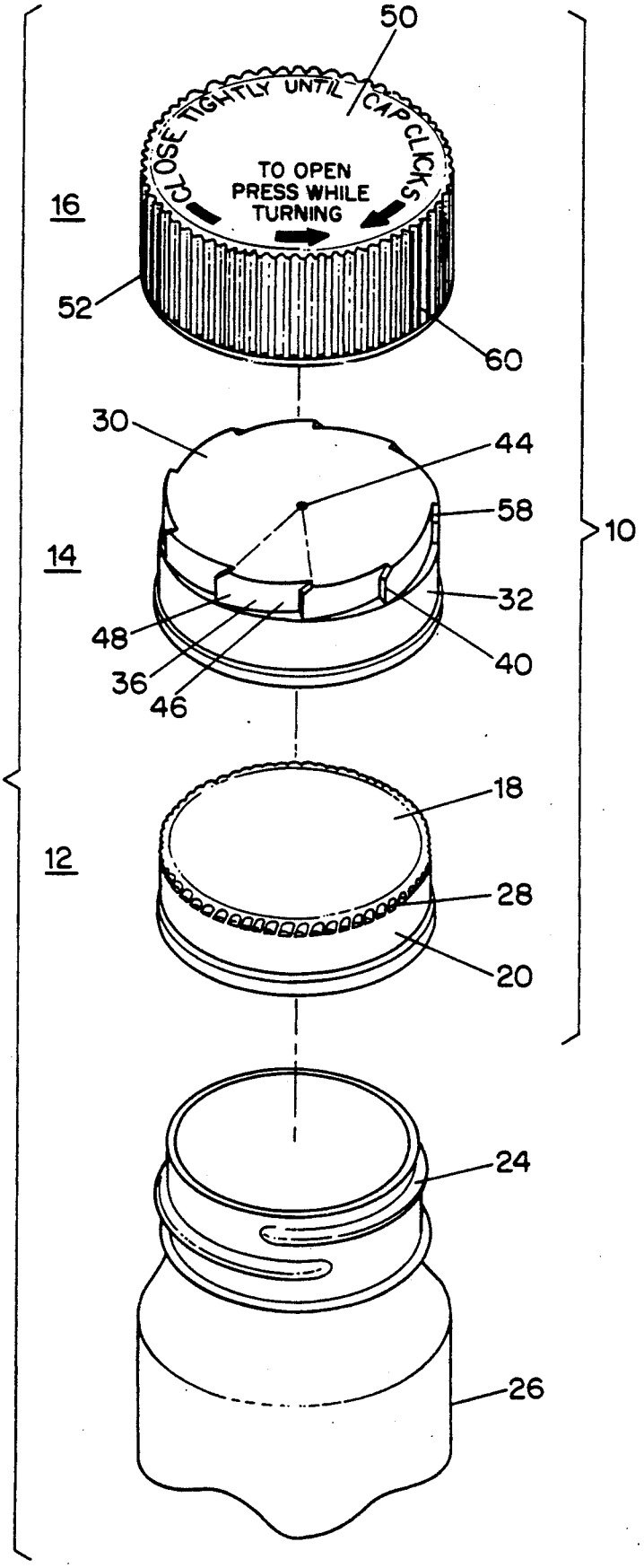
FIG. 1 is an exploded perspective view of a child-resistant closure which is rotatable for producing an audible closure-state indicating signal and bottle constructed and arranged in accordance with the invention.
Figure 4:
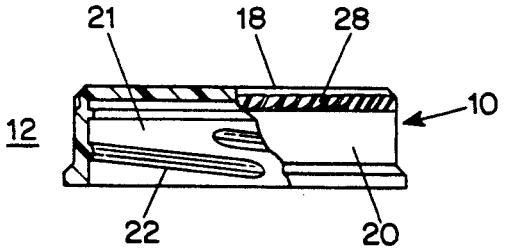
FIG. 4 is a partial cross-sectional side view of the inner cap of the child-resistant closure of FIG. 1.

Referring specifically to FIG. 1 of the drawings, a child-resistant closure 10 is constructed and arranged in accordance with the invention. Closure 10 includes an inner cap 12, a middle cap 14 and an outer cap 16 which are in axial alignment and in nested relation with one another. The inner cap 12 has a circular top wall portion 18, a cylindrical skirt 20 depending from the top wall portion 18 and an inner surface 21 of the skirt 20, as shown in FIG. 4. The inner surface 21 has a threaded portion 22 for threaded engagement with a threaded portion 24 of a container 26 when the inner cap 12 is rotated in a closing direction, here shown by way of example to be clockwise. The inner cap 12 is disengageable from the threaded portion 24 of the container 26 when rotated in an opening direction, here, e.g. counterclockwise. The inner cap also has a plurality of angularly extending knurlings 28 located on the outer surface of the skirt 20 which angle downwardly and in the closing direction.

Figure 3:
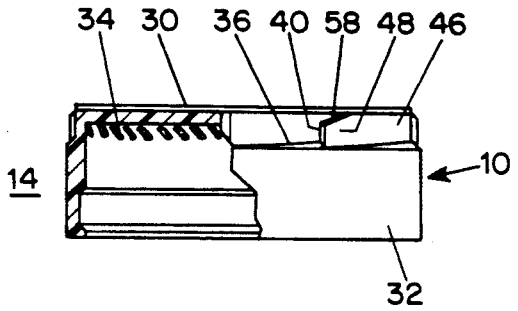
FIG. 3 is a partial cross-sectional side view of the middle cap of the child-resistant closure of FIG. 1.

The middle cap 14 has a circular top wall portion 30 and a cylindrical skirt 32 coaxial with and peripherally surrounding the cylindrical skirt portion 20 of the inner cap 12 As shown in FIG. 3, the inner portion of the skirt 32 of the middle cap 14 has a plurality of angularly extending knurlings 34 complementary to and angled in the same direction as the plurality of angularly extended knurlings 28 located on the outer surface of skirt 20 of the inner cap 12. Thus, when the middle cap 14 is rotated in an opening direction, the complementary middle cap knurlings 34 tend to ride up the inner cap knurlings 28 to prevent transmission of the opposite direction rotation from the middle cap 14 to the inner cap 12, the middle cap 14 being axially displaceable relative to the inner cap 12, in order to prevent the disengagement of the inner cap 12 from the container 26 This can only be overcome by the simultaneous application of a turning force and an axial force, the latter of which prevents the knurlings on the middle cap from riding up the knurlings on the inner cap.

Figure 7:
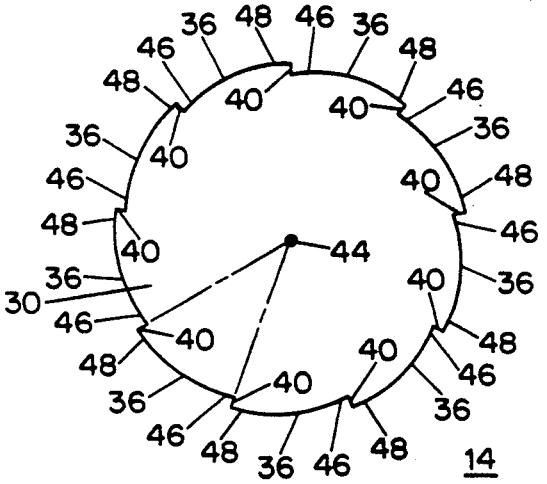
FIG. 7 is a top plan view of the middle cap of the child-resistant closure of FIG. 3.

The middle cap 14 is provided on the skirt 32 with one or more cam surfaces 36, here shown in FIGS. 1 and 7 as nine in number, which angle outwardly from the center of middle cap 14 as the cam surface extends in the direction of closing. Each cam surface 36 has a front end 48 and a trailing end 46 with the front end 48 being at a greater radial distance from the center than the trailing end 46. Thus, the front end 48 of the cam surface in the closing direction is further from the center 44 of middle cap 14 than in the trailing end 46 of the cam surface 36. An abutment edge 40 is located where the trailing end 46 meets the front end 48 of the cam surface 36. Preferably each abutment edge 40 has an upper downwardly extending sloped surface 58, as shown in FIGS. 1 and 3, so that during manufacture the outer cap 16 is easily installed on the middle cap 14.

The outer cap 16 is arranged for rotation relative to the middle and inner caps 12, 14 and has a circular top 50, a cylindrical skirt 52 coaxial with and peripherally surrounding the skirt 32 of the middle cap 14 and means 54 for frictionally engaging cam surface 36 as shown in FIGS. 2, 5, 8 and 9. Preferably the outer cap 16 also has a means for gripping the closure 10, here shown as vertical ribs 60 arranged along the outer side of the cylindrical skirt 52.

Figure 9:
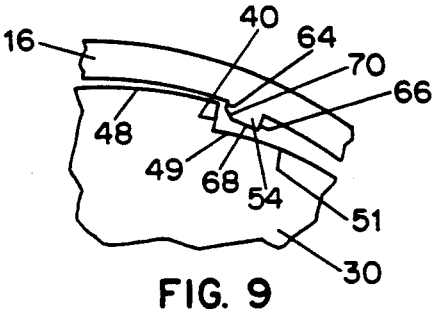
FIG. 9 is a partial cross-sectional view of the outer and middle caps of FIG. 8 after producing the audible closure-state indicating signal.

The means for frictional engagement 54 with the radially differing cammed surface 36 of the middle cap 14 provides an increasing interference fit between the middle and outer caps 14, 16, as the outer cap 16 is rotated in a closing direction so that the outer cap 16 first frictionally engages the middle cap 14 in a torquing manner causing the middle cap 14 to remain stationary relative to the outer cap 16 (i.e. to rotate with the outer cap). The complimentary knurlings 28, 34 on the middle and inner caps 14, 12 also cause the inner cap 12 to remain stationary relative to the outer cap 16 so that as force is transmitted to rotate the outer cap 16, to fully close the container 26, the threaded portion 22 of the inner cap 12 seals the threaded portion 24 of the container 26. Upon full closure being achieved, the inner and middle caps are prevented from rotating and continued torquing of the outer cap causes the means for frictional engagement 54 on the outer cap to ride over the radially differing cammed surface 36 of the middle cap 14 until it is rotated past the front end 48 of the cam surface 36, over the abutment edge 40 and onto the trailing end 46 of the next cam surface 36, where its quick disengagement of the frictional engaging means and the cam causes an audible closure-state indicating "click" signal to be produced when the engagement means 54 contacts the trailing end of the next cam surface as shown in FIG. 9.

In order to use the child-resistant closure provided in accordance with the invention, the user first places the closure 10 on the container 26 and uses a rotative force to turn the outer cap 16 in the closing direction. The means for frictional engagement 54, interferes with the cam surface 36 and causes the outer cap 16 to remain stationary relative to the middle cap 14. The complimentary knurlings 28, 34 on the middle and inner caps 14, 12 also cause the inner cap 12 to remain stationary relative to the outer cap 16. Thus, as the user closes the container, the rotative force provided engages the threaded portion 24 of the container 26 with the threaded portion 22 of inner cap 12. Once the container 26 is fully closed and the inner cap can be turned no more, the user can continue to apply a rotative force, so that the interference fit provided by the means for frictional engagement 54 is increased when the means for frictional engagement 54 rides on the cam surface 36 toward the front end 48 of the cam surface 36, which, is farther from the center 44 of the middle cap 14 than the trailing edge 46 of the cam surface 36. Thus, the outer cap 16 moves relative to the middle and inner caps 14, 12. The middle cap 14 remains stationary relative to the inner cap 12 due to the fact that it is fixed relative to the now stationary inner cap by the complimentary interengaged knurlings 28, 34. The outer cap 16 is rotated until the frictional engagement means 54 is rotated past the front end 48, over the abutment point 40 and onto the trailing end 46 of the next cam surface 36, where its quick disengagement of the frictional engaging means and the cam causes an audible "click" sound when the engagement means 54 contacts the trailing edge of the following cam surface 36 so that the user can determine whether the closure 10 is in a fully closed or sealed condition.

In order to open the sealed container 26, the user must utilize both a rotative and an axial force, the latter of which prevents the knurlings 34 on the middle cap 14 from riding up the knurlings 28 on the inner cap 12. Thus, when the outer cap 16 is rotated in an open direction, with the use of both rotational and axial force, the outer cap 16 first moves relative to the middle and inner caps 14, 12. The complimentary knurlings 34 on the middle caps 14 which have a tendency to ride up the inner cap 12, are overcome by the axial force. Thus, the outer cap is first to move relative to the middle and inner caps because the means for frictional engagement 54 is overcome when the means for frictional engagement 54 rides on the cam surface 36 toward the trailing end 46 which is closer to the center 44 of the middle cap 14 than the front end 48 of the cam surface 36. As the opening continues, the means for frictional engagement 54 abuts the abutment point 40 and the axial force prevents the knurlings 34 in the middle cap 14 from riding up the knurlings 28 on the inner cap 12 so that all three caps move in unison. This allows the threaded portion 22 of the inner cap 12 to be disengaged from the threaded portion 24 of the container 26. Accordingly, the closure 10 is disengaged from the container 26.

Figure 2:
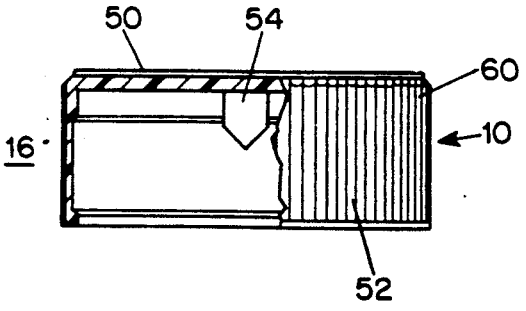
FIG. 2 is a partial cross-section al side view of the outer cap of the child-resistant closure of FIG. 1.

As shown in FIG. 2, the means for frictional engagement 54 with the radially differing cam surface 36 comprises one or more elements projecting radially inward from the outer cap 16 with the radial projecting element 54 being sized and configured to increasingly interfere with the radially differing grooved when the outer cap 16 is rotated to close the container 26. As shown by way of example only in FIG. 5, three such pairs of projecting elements 54 are uniformly spaced about the skirt 52 of the outer cap 16 to correspond with the cammed surfaces 36 of the middle cap 14.

Figure 5:
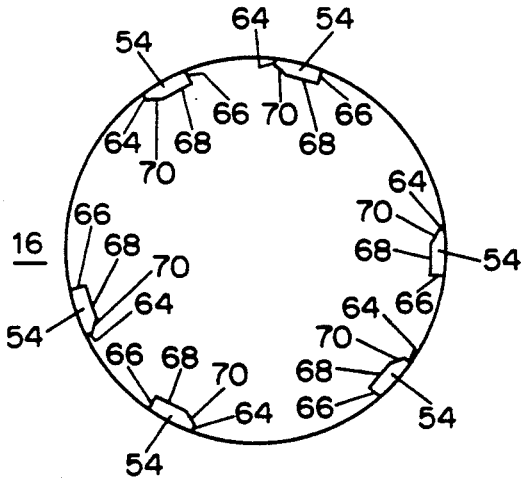
FIG. 5 is a bottom view of the outer cap as shown in FIG. 2.

As shown in FIG. 5 and as a preferred embodiment, each radial projecting element 54, has a first edge 64, a second edge 66 and a frictionally engaging surface 68. An angled portion 70 is provided to connect the first edge 64 and the frictionally engaging surface 68 in order to ensure full contact of the frictionally engaging surface 68 with the corresponding cam surface 36.

Figure 6:
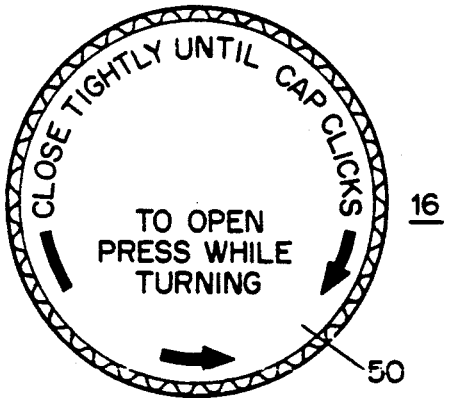
FIG. 6 is a top plan view of the outer cap of the child-resistant closure of FIG. 2.

FIG. 6 shows the top surface 50 of the outer cap. To open the child-resistant screw-on closure 10, the user applies both an axial and a rotative force in order to prevent disengagement of the inner and middle caps and turn the entire closure 10 in a anticlockwise or opening direction. To close the child-resistant closure 10, the user turns the closure 10 in an clockwise direction.

FIG. 7 shows the top surface 30 of the middle cap 14. A plurality of cam surfaces 36 which have a front end 48 and a trailing end 46 are shown along the circumference of the outer skirt. The radially distance from the front end 48 of the cammed surface to the center 44 of the middle cap 14 is greater in the closing direction than the radially distance from the trailing end 46 of the cammed surface to the center 44 of the middle cap 14 in the opening direction. The middle cap is also provided with an abutment edge 40 located where the trailing end 46 meets the front end 48 of the cammed surface. By way of example, FIG. 7 shows 9 cammed surfaces.

Figure 8:
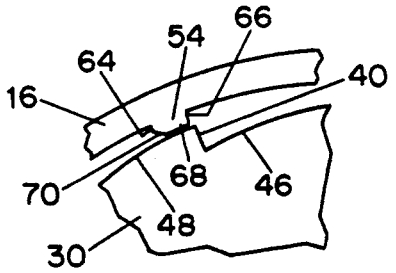
FIG. 8 is a partial cross-sectional view of the outer and middle caps showing the radial projecting element prior to producing the audible closure-state indicating signal.

FIGS. 8 and 9 show a partial cross-sectional view of the outer 16 and middle 14 caps as well as the means for frictional engagement 54. Specifically, FIG. 8 shows engagement means 54 riding along and in frictional engagement with the front end 48 of cam surface 36. FIG. 9 shows the engagement means 54 after being rotated past the front end 48, over the abutment edge 40 and onto the trailing end of the next cammed surface 51 where its quick disengagement of the frictional engaging means and the cam causes an audible closure-state indicating "click" signal to be produced.

FIGS. 2 and 3 show a preferred embodiment of the invention where the bottom of the means for frictional engagement 54 is pointedly angled in a roof-like manner or a picket surface and the upper edge 58 of abutment edge 40 is angled in order to facilitate assembly. Thus, when the outer cap 16 is placed on the middle cap 14, and if the means for frictional engagement 54 and the abutment edge 40 come into contact, the angle of the upper edge 58 of the abutment edge 40 insures that the means for frictional engagement 54 will easily slide in the cam 36 of the middle cap 14.

It will also be understood that while the one-way torque transmitting means made up of angled knurlings 28 and 34 is preferred, other one-way transmitting means may be employed herein without departing from the present invention.

It is to be understood that the child-resistant closure device with relative rotatable components provided in accordance with the invention can be formed of any suitable material such as plastic or metal or a combination of materials and the like and that the invention is not intended to be limited by the material from which the devices are formed.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A child-resistant closure for use on a container having a threaded portion threadedly engageable with the closure, the closure producing an audible closure-state indicating signal when closed, comprising:

an inner cap having a circular top wall portion and a cylindrical skirt depending from said top wall portion, an inner surface of said skirt being threaded for threaded engagement with the threaded portion of said container when said inner cap is rotated in a closing direction and disengageable therefrom when said inner cap is rotated in an opening direction;

a middle cap comprising:

a circular top wall portion, a cylindrical skirt arranged coaxial with and peripherally surrounding said cylindrical skirt portion of said inner cap, said middle cap being axially displaceable relative to said inner cap, and a cam surface having a front end and a trailing end, with respect to the closing direction, being arranged along the circumference of an outer portion of said skirt of said middle cap, said front end being at a greater radial distance from a center axis of said middle cap than said trailing end and an abutment edge defined by the intersection of said trailing end and said front end of said cam surface;

an outer cap arranged for rotation relative to said middle and inner caps and having a circular top, a cylindrical skirt coaxially arranged and peripherally surrounding said skirt of said middle cap, means for frictional engagement with said cam surface of said middle cap for providing a progressively increasing frictional engagement between said middle and outer caps as said outer cap is rotated in the closing direction for permitting the rotation of said outer cap relative to said middle cap until said frictional engagement means frictionally engages said cam surface to transmit torque thereto and until said frictional engagement means is rotated past said front end of said cam surface, over said abutment edge and onto said trailing end to produce the audible closure-state indicating signal; and one-way torque transmitting means for causing said middle cap and said inner cap to rotate concurrently in the closing direction and for preventing concurrent rotation of said inner and middle caps in the opening direction in the absence of an application of axial force thereto, whereby rotation of said outer cap in the closing direction will cause like rotation of said middle and inner caps so that the threaded portion of the inner cap engages with the threaded portion of the container, and thereafter, said outer cap moves relative to said middle and inner caps causing said means for frictional engagement to ride on said cam surface of said middle cap increasing said frictional engagement and to ride past said front end of said cam surface, over said abutment edge and onto said trailing end for producing the audible closure-state indicating signal and when said outer cap is rotated in the opening direction with both rotational and axial forces applied to said outer cap, said outer cap first moves relative to said inner cap allowing said means for frictional engagement to abut said abutment edge wherein the closure is disengaged from said container.

2. The child-resistant closure of claim 1, wherein said one-way torque transmitting means comprises a plurality of angularly extending knurlings located on the inner portion of said cylindrical skirt of said middle cap and a plurality of angularly extended knurlings located on the outer skirt of said inner cap complimentary to and angled the same way as the plurality of angularly extending knurlings located on the inner portion of the cylindrical skirt of said middle cap so that when said middle cap is rotated in said opening direction, the complementary middle cap knurlings ride up the inner cap knurlings to prevent transmission of said opening direction rotation from said middle cap to said inner cap.

3. The child-resistant closure of claim 1, wherein said means for frictional engagement comprises a radially projecting element having a lower edge, a trailing edge and a leading edge with respect to the closing direction, and a frictionally engaging surface disposed between said trailing and leading edges.

4. The child-resistant closure of claim 3, wherein as said outer cap is rotated in a closing direction, said trailing edge is at a greater radial distance from the center axis of said outer cap than said leading edge.

5. The child-resistant closure of claim 3, wherein said trailing edge is provided with a portion which forms a predetermined angle with said frictional surface.

6. The child-resistant closure of claim 3, wherein said means for frictional engagement is pointedly angled on said lower edge so that said means for frictional engagement is engageable on said cam surface.

7. The child-resistant closure of claim 1, wherein said middle cap is provided with a plurality of cam surfaces along the circumference of said outer skirt of said middle cap, each of said cam surfaces having a front end, a trailing end and an abutment edge.

8. The child-resistant closure of claim 7, wherein said means for frictional engagement comprises a plurality of radially projecting elements.

9. The child-resistant closure of claim 8, wherein said means for frictional engagement comprises three pairs of radially projecting elements.

10. The child-resistant closure of claim 7, wherein said middle cap is provided with nine cam surfaces.

11. The child-resistant closure of claim 1, wherein said abutment edge of said middle cap is provided with a downwardly angled upper surface for engaging said means for frictional engagement on said cam surface.

12. The child-resistant closure of claim 1, wherein the outer, middle and inner caps comprise a plastic material.

13. The child-resistant closure of claim 1, wherein said outer cap further comprises an outer cylindrical skirt coaxial with and peripherally surrounding the skirt of said middle cap wherein said outer cylindrical skirt is provided with means for gripping said outer cap.

14. The child-resistant closure of claim 13, wherein said means for gripping said outer cap comprises a plurality of parallel spaced vertical ribs.

15. The child-resistant closure of claim 1, wherein the audible closure-state indicating signal comprises a click.

* * * * *